US007386996B2

(12) United States Patent
Fredheim et al.

(10) Patent No.: US 7,386,996 B2
(45) Date of Patent: Jun. 17, 2008

(54) NATURAL GAS LIQUEFACTION PROCESS

(75) Inventors: Arne Olay Fredheim, Trondheim (NO); Pentti Paurola, Hafrsfjord (NO)

(73) Assignee: Den Norske Stats Oljeselskap A.S., Stavanger (NO)

( * ) Notice: Subject to any disclaimer, the term of this patent is extended or adjusted under 35 U.S.C. 154(b) by 572 days.

(21) Appl. No.: 10/221,885

(22) PCT Filed: Mar. 15, 2001

(86) PCT No.: PCT/GB01/01136

§ 371 (c)(1),
(2), (4) Date: Dec. 23, 2002

(87) PCT Pub. No.: WO01/69149

PCT Pub. Date: Sep. 20, 2001

(65) Prior Publication Data

US 2003/0089125 A1 May 15, 2003

(30) Foreign Application Priority Data

Mar. 15, 2000 (GB) ..... 0006265.3

(51) Int. Cl.
*F25J 1/00* (2006.01)

(52) U.S. Cl. ..... 62/612

(58) Field of Classification Search ..... 62/606, 62/611, 612, 613
See application file for complete search history.

(56) References Cited

U.S. PATENT DOCUMENTS

| | | | | |
|---|---|---|---|---|
| 3,323,315 | A * | 6/1967 | Carr | 62/613 |
| 3,581,510 | A * | 6/1971 | Hughes | 62/612 |
| 4,017,203 | A | 4/1977 | Marantette et al. | |
| 4,459,142 | A * | 7/1984 | Goddin, Jr. | 62/635 |
| 4,548,629 | A * | 10/1985 | Chiu | 62/621 |
| 5,588,306 | A | 12/1996 | Schmidt | |
| 5,768,912 | A | 6/1998 | Dubar | |
| 5,916,260 | A | 6/1999 | Dubar | |
| 6,016,665 | A * | 1/2000 | Cole et al. | 62/612 |
| 6,023,942 | A | 2/2000 | Thomas et al. | |
| 6,212,891 | B1 * | 4/2001 | Minta et al. | 62/50.7 |
| 6,324,867 | B1 * | 12/2001 | Fanning et al. | 62/613 |

FOREIGN PATENT DOCUMENTS

| | | |
|---|---|---|
| WO | WO98/48227 | 10/1998 |
| WO | WO98/54524 | 12/1998 |
| WO | WO98/59206 | 12/1998 |
| WO | WO98/59207 | 12/1998 |

* cited by examiner

*Primary Examiner*—William C. Doerrler
(74) *Attorney, Agent, or Firm*—Scully, Scott, Murphy & Presser, P.C.

(57) ABSTRACT

The invention relates to a natural gas liquefaction process and particularly to one suited to use offshore. The invention provides a natural gas liquefaction apparatus wherein a carbon dioxide based pre-cooling circuit is provided in a cascade arrangement with a main cooling circuit. The invention also extends to a natural gas liquefaction apparatus wherein a main cooling circuit uses as a refrigerant a gas stream, at least a portion of which is derived from a raw natural gas source.

18 Claims, 5 Drawing Sheets

NATURAL GAS LIQUEFACTION PROCESS

The present invention relates to a natural gas liquefaction process and particularly, but not exclusively, to one suited for use offshore.

Natural gas can be obtained from the earth to form a natural gas feed which must be processed before it can be used commercially. Normally the gas is first pretreated to remove or reduce the content of impurities such as carbon dioxide, water, hydrogen sulphide, mercury, etc.

The gas is often liquefied before being transported to its point of use to provide liquefied natural gas (LNG). This enables the volume of gas to be reduced by about 600 fold, which greatly reduces the transportation costs. Since natural gas is a mixture of gases, it liquefies over a range of temperatures. At atmospheric pressure, the usual temperature range within which liquefaction occurs is between −165° C. and −155° C. Since the critical temperature of natural gas is about −80° C. to −90° C., the gas cannot be liquefied purely by compressing it. It is therefore necessary to use cooling processes.

It is known to cool natural gas by using heat exchangers in which a gaseous refrigerant is used. One well-known method comprises a number of cooling cycles, typically three, in the form of a cascade. In such cascades, refrigeration may be provided by methane, ethylene and propane in sequence. Another type of cascade arrangement which uses mixed refrigerant streams is described in WO 98/48227. Another known system uses a mixture of hydrocarbon gases, such as propane, ethane and methane in a single cycle and a separate propane refrigeration cycle to provide cooling of the mixed refrigerant and natural gas.

It will be appreciated that the use of hydrocarbons as refrigerants poses a safety issue and this is particularly significant in the offshore environment, where it is highly undesirable to have large liquid hydrocarbon inventories in what is inevitably a confined space.

As an alternative, Thomas et al (U.S. Pat. No. 6,023,942) discloses a natural gas liquefaction process in which carbon-dioxide may be used as a refrigerant. However, this process is not suitable for large scale or offshore applications since it relies not on a cascade arrangement but on an open-loop expansion process as the primary means of cooling the LNG stream. Expansion processes such as this do not allow sufficiently low temperatures to be attained, and hence the LNG has to be kept at very high pressures to maintain it in liquid form. Both from a safety and an economic point of view, these high pressures are not suitable for industrial production of LNG, and particularly not for large scale or offshore applications.

A further alternative would be a nitrogen cycle based process, but this has the significant disadvantage that the thermal efficiency is much lower than a hydrocarbon based system. In addition, because nitrogen has a low heat transfer co-efficient, a large heat transfer area is required to dissipate the waste heat from the process into a cooling medium. Consequently, despite the safety hazards involved, hydrocarbon-based refrigeration cycles continue to be used.

According to the present invention there is provided a natural gas liquefaction apparatus, wherein a carbon dioxide based pre-cooling circuit is provided in a cascade arrangement with a main cooling circuit.

By means of this arrangement, it is possible to use safer refrigerants in the main cooling circuit, compared to the above-mentioned hydrocarbon based cycles, whilst reducing the energy consumption involved by using such cycles.

As discussed above, in a cascade arrangement, cooling is carried out by a series of refrigeration cycles which are typically in the form of a closed loop system. Typically, the arrangement is such that the natural gas stream passes through a series of interrelated heat exchangers which are arranged such that at least one coolant stream passes through a plurality of heat exchangers in sequence. Preferably two or more refrigeration streams are used and the arrangement may then be such that one stream passes through one heat exchanger and a further stream passes through that heat exchanger and a further one. Where three heat exchangers are provided there may be three coolant streams with one passing through each heat exchanger, one through two of these, etc.

Furthermore, it is possible to derive the carbon-dioxide from the natural gas feed. As mentioned above, carbon-dioxide is normally removed from the gas during the pre-treatment stage and is usually vented to the atmosphere or reinjected back to nearby reservoirs. Thus, not only is the $CO_2$ readily available, but also the environmentally undesirable release of $CO_2$ may to some extent reduced.

The $CO_2$-based pre-cooling circuit may contain other gases, for example hydrocarbons, but preferably these amount to less than 5 mol %, and it is particularly preferred for the gas to be essentially pure $CO_2$.

Furthermore, the use of $CO_2$ means that it is possible use comparatively high suction pressures for the refrigerant medium compressors (of the order of 6 to 10 bara), such that small diameter piping can be used which results in a more compact design. Together, these features lead to a very small footprint for the cryogenic section of the plant (i.e. that part operating at below −40° C.), which is of particular importance in an offshore application.

Preferably, the suction of the refrigeration compressors receives unheated, cold refrigerant medium directly from the cryogenic heat exchangers.

Preferably, the main cooling circuit comprises a nitrogen rich based circuit, i.e. one which uses a refrigerant which is rich in nitrogen. This may be essentially pure nitrogen such that the refrigerant gas which is flowing through the expansion loops of the main cooling circuit forms a non-combustible mixture. The nitrogen gas may be obtained from the atmosphere.

Thus, in a preferred embodiment, the main cooling cycle(s) comprise nitrogen rich based expansion loop(s). In these loops the refrigerant is a nitrogen rich composition and the refrigerant is itself cooled using an expansion loop mechanism.

In order to improve the efficiency of operation of the apparatus, other gases, such as hydrocarbons may be mixed with the nitrogen. The main cooling circuit preferably contains a plurality of cycles and the first of these may preferably be richer in nitrogen than subsequent cycles. This is because the first cycle is the coldest cycle, and advantageously contains more nitrogen than the subsequent warmer cycles. The nitrogen rich stream may be a mixture of nitrogen with any other suitable gas, preferably hydrocarbons such as $C_1$ to $C_5$ hydrocarbons, particularly methane, ethane, propane, butane, pentane, ethylene or propylene. For example, the first cycle may use essentially pure nitrogen, or as little as 30 mol % nitrogen. Generally the refrigerant stream may comprise about 50–100 mol % nitrogen and about 0–50 mol % hydrocarbons, but preferably at least 80 mol % nitrogen is used which may be combined with methane and ethane (for example 80 mol % nitrogen, 15 mol % methane, 5 mol % ethane). The subsequent cycles may contain significantly less nitrogen and correspondingly more hydrocarbon gas, for example, as little as 5 to 20 mol % nitrogen may be used in subsequent cycles.

A further advantage of these embodiments of the invention is that the required hydrocarbon make-up is easily available from the LNG production process, without the need for a dedicated fractionation system as is usually required in the prior art. Thus, although flammable hydrocarbon gases are used as refrigerants in these embodiments, large inventories of them need not be specially stored. Rather, they may be obtained from the natural gas itself.

In addition, nitrogen and/or hydrocarbon used in the system as a refrigerant can also be obtained from the natural gas. The use of such a supply in this context is believed to be inventive, and so viewed from a different aspect, the invention provides a natural gas liquefaction apparatus wherein a cooling circuit uses as a refrigerant a gas stream at least a portion of which is derived from the raw natural gas source. For example, nitrogen or hydrocarbon or a nitrogen enriched refrigerant stream may be obtained from the same raw natural gas source as the natural gas to be liquefied. It is preferred that a nitrogen enriched natural gas stream is used. It is also preferred that the gas stream has a portion made up from the light hydrocarbon stream from the reflux drum of a heavy hydrocarbon removal tower.

In general, the raw natural gas stream will contain a sufficient amount of hydrocarbons to satisfy the requirements of the refrigerant cooling stream. However, since generally more nitrogen is required in the refrigerant stream, it may be necessary to supplement the nitrogen from the raw natural gas with nitrogen from other sources. Nitrogen gas is readily available and may for example be obtained from the cryogenic separation of air. It will be appreciated that a suitable mixture of nitrogen and hydrocarbon obtained from the raw natural gas source, and if necessary topped up by additional nitrogen gas, may be used as a ready and reliable source of the refrigerant stream. In such a case, the apparatus is considerably simplified.

Hydrocarbons can be recycled from various sources in the gas liquefaction process. For example, the makeup hydrocarbon may be taken from the reflux drum of the heavy hydrocarbon-removal tower. Preferably the make-up hydrocarbon for the gas stream is taken partly from the overhead hydrocarbon removal tower and partly from the reflux drum of the heavy hydrocarbon removal tower, the heavier hydrocarbons being more suitable for the later cooling stages. This forms a highly efficient dual flow carbon dioxide pre-cooled mixed refrigeration process.

In a preferred embodiment of the invention, the first nitrogen-based cycle includes hydrocarbons derived from the overhead of the hydrocarbon removal tower. The later cycles may comprise hydrocarbons that have been refluxed. In both cases it has been found that a useful refrigerant gas mainly free of aromatic hydrocarbons is produced. It will be appreciated that the presence of aromatics is undesirable because of their tendency to freeze. The bottom product from the heavy hydrocarbon removal unit can be routed to the condensate stabiliser column.

As a refinement of the invention, the bottoms from the hydrocarbon removal units may be sent to a condensate stabilising unit.

Typically, the above described apparatus is arranged to provide three separate streams, namely condensate, LNG and LPG, in line with conventional practice. However, it has now surprisingly been found that only two separate product streams need to be produced: LNG and a combined condensate/LPG stream (unstabilised condensate product). Such products have the considerable advantage that they can be transported more easily than the three conventional product streams. Thus, it may be simpler and more cost effective to transport an unstabilised condensate product stream than to transport the LPG and stabilised condensate components separately. This is itself regarded as inventive, and so viewed from another aspect, therefore, the invention provides a method of producing liquefied natural gas (LNG) wherein an unstabilised condensate product stream is produced. From a still further aspect, the invention provides a method of transporting natural gas product, comprising the provision of an unstabilised condensate product stream, and the subsequent transportation of said stream, for example by pipe, ship, tanker, etc.

As mentioned above, the use of refrigerants (in particular nitrogen and hydrocarbons) obtained from the gas feed is regarded as providing further inventive matter and therefore, viewed from a further aspect, the invention provides a method of liquefying natural gas wherein gas(es) obtained from the natural gas feed are used as refrigerants. In preferred forms the refrigerants thereby obtained include carbon dioxide, nitrogen and/or hydrocarbons as discussed above which may be used in cascading cycles.

A further and general advantage of the invention is that the processing steps are not sensitive to the motions that occur in any floating LNG plant and the process is simple to operate in all transient operation situations.

Embodiments of the events will now be described, by way of example only, and with reference to the accompanying drawings, in which:

FIG. 1 schematically represents the natural gas liquefaction process in accordance with a first embodiment of the invention.

FIG. 2 schematically represents an alternative natural gas liquefaction process in accordance with a second embodiment.

Figure 1:
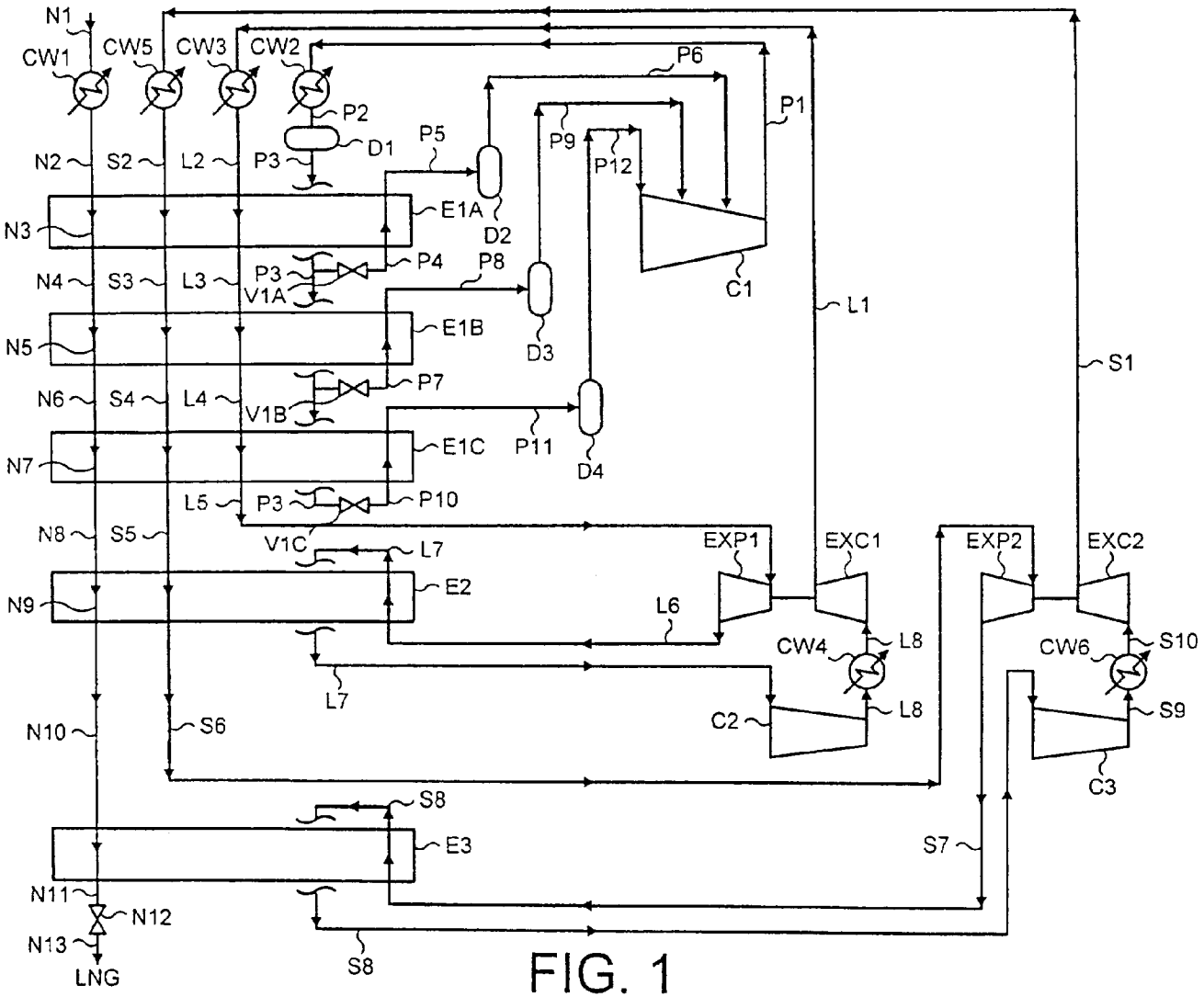

The natural gas liquefaction process shown in FIG. 1 is designed for use off-shore and comprises essentially a natural gas circuit with pre-cooling, a liquefaction circuit and a sub-cooling refrigeration circuit.

The pre-treated natural gas stream N1 is pre-cooled down to 8–30° C. in the water cooler CW1 at 30–70 barg. The pre-cooled natural gas N2 is introduced into cryogenic heat exchangers E1A, E1B and E1C where it is partially condensed and pre-cooled down to about −30 to 50° C. After this pre-cooling step, the natural gas N8 is liquefied in the cryogenic heat exchanger E2 at about −80° C. to −100° C. Then the liquefied natural gas N10 is sub-cooled to about −150° C. to −160° C. in the cryogenic heat exchanger E3. After the sub-cooling, the LNG steam N11 is expanded close to the atmospheric pressure in the Joule Thompson valve N12 (or alternatively in a cryogenic liquid turbine). The LNG is further routed to a nitrogen removal unit before it is pumped to an LNG storage.

The pre-cooling refrigerant is dry carbon dioxide which is preferably taken from a $CO_2$ removal part of the pre-treatment process, but it could be taken from other sources e.g. CO2 can be imported. The $CO_2$-stream provides cooling for the natural gas N2, liquefaction refrigerant L2 and sub-cooling refrigerant S2 down to a level of about −30 to −55° C. In order to achieve these temperatures, vaporisation of the carbon dioxide within the cooling circuit must take place. The critical temperature of carbon dioxide therefore imposes an upper limit on the temperature of the carbon dioxide streams P4, P7 and P10 which are used in heat exchangers N3, N5 and N7. The refrigeration is provided by the compressed pre-cooling refrigerant P1 which is first condensed in the cooler CW2 by the use of sea water. Sea water is conveniently used because it is available even in remote locations in warm climates. In practice the cooling water in unit CW2 should be at least below about 28° C. to achieve sufficient pre-cooling with carbon dioxide. If necessary, seawater from the depths of the ocean may be used as this will be cooler than seawater at the surface. The condensed pre-cooling refrigerant stream P3 from the drum D1 is flashed through Joule Thompson valves V1A, V1B and V1C in three pressure levels in cryogenic heat exchanges E1A, E1B and E1C. The vaporised pre-cooling refrigerants P5, P8 and P11 are returned through the suction drums D2, D3 and D4 to the compressor C1 where the pre-cooling refrigerant is recompressed up to 45 to 60 barg because of the three different pressure levels (5.5 to 7 barg, 10 to 20 barg and 25 to 35 barg) at which pre-cooling refrigerants P4, P7 and P10 evaporate, the streams are returned to the compressor C1 at three different pressure levels. The compressor C1 is designed to receive the low pressure stream P12 (5.5 to 7 bara) at the suction and other medium pressure streams P9 and P6 (10 to 20 bara and 25 to 35 bara) at interstage positions. This improves the efficiency of the pre-cooling cycle. The required liquid hold-up for the pre-cooling circuit is provided by the drum D1.

The liquefaction refrigerant L1 is a dry nitrogen rich stream containing essentially N2 (50 to 100 mol %) and light hydrocarbons (0 to 50 mol %) which liquefies the natural gas at −80° C. and provides cooling for sub-cooling refrigerant down to a level of −80° C. to −100° C. The refrigeration is provided by the compressed and pre-cooled liquefaction refrigerant L5 by expanding it in the expander EXP1 to lower pressure (2 to 12 bara) and low temperature (−80° C. to −130° C.) in the cryogenic heat exchanger E2. The liquefaction refrigerant L7 is heated up to about −40 to −60° C. and routed to the suction of the refrigeration compressor C2 where it is recompressed up to 30 to 50 barg. The recompressed refrigerant stream L8 is cooled in the cooler CW4 and compressed further in the booster compressor EXC1 from 40 to 70 barg. The booster compressor EXC1 is directly coupled with the expander EXP1. The high pressure nitrogen L1 is routed through the after cooler CW3 and the cryogenic heat exchangers E1A, E1B and E1B being cooled down about −30 to −55° C. before it is recycled to the suction of the expander EXP1.

The sub-cooling refrigerant cycle is designed to sub-cool the LNG so that not more than the required quantity of flash gas is produced after expansion of the LNG in the downstream nitrogen removal unit. The sub-cooling refrigerant is dry nitrogen rich stream containing essentially N2 (50 to 100 mol %) and light hydrocarbons (0 to 50 mol %), The refrigeration is provided by the compressed and pre-cooled sub-cooling refrigerant S6 by expanding it in the expander EXP2 to lower pressure (2 to 12 bara) and lower temperature (−160 to −175° C.) in the cryogenic heat exchanger E3. The sub-cooling refrigerant S8 is heated up to about −80 to −100° C. and routed to the suction of the refrigeration compressor C3 where is recompressed up to 50–60 barg. The compressor C3 could be integrated with the refrigerating compressor C2 in order to reduce capital costs. The recompressed refrigerant S9 is cooled in the cooler CW6 and compressed further in the booster compressor EXC2 to 60–90 barg. The booster compressor EXC2 is directly coupled with the expander EXP2. The high pressure nitrogen rich S1 is routed through the after cooler CW5 and the cryogenic heat exchangers E1A, E1B, E1C and E2 being cooled down to about −80° C. to −100° C. before it is recycled back to the expander.

The high pressure liquefaction refrigerant L2 and sub-cooling refrigerant S1 could be combined to a common high pressure refrigerant stream in the heat exchangers E1A, E1B and E1C if this is seen to be a more cost effective concept.

Figure 2:
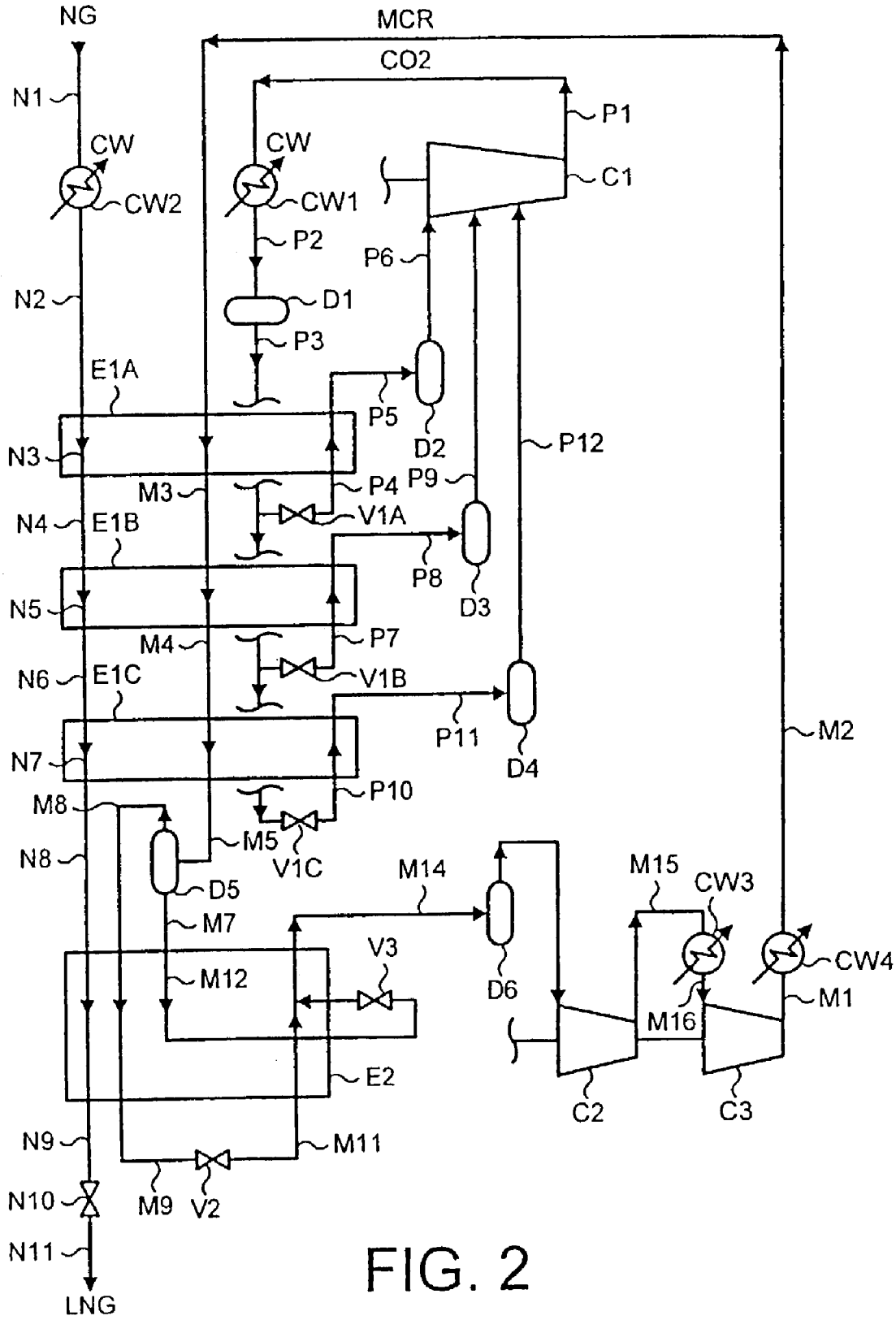

The second embodiment shown in FIG. 2 comprises essentially: a natural gas circuit with pre-cooling unit and main cooling circuits.

The pre-treated natural gas stream N1 is pre-cooled down to 8–30° C. in the water cooler CW2 at 30 to 70 barg. The pre-cooled natural gas N2 is introduced into the cryogenic heat exchangers E1A, E1B and E1C where it is partially condensed and pre-cooled down to about −30 to −55° C. After the pre-cooling step, the natural gas N8 is liquefied and sub-cooled in the cryogenic heat exchanger E2 down to about −150° C. to −160° C. After the sub-cooling, the LNG stream N9 is expanded close to the atmospheric pressure in the Joule Thompson valve N10 (or alternatively in a cryogenic liquid turbine). The LNG is further routed to a nitrogen removal unit before it is pumped to an LNG storage.

The pre-cooling refrigerant is a dry carbon dioxide taken from a $CO_2$ removal part of the pre-treatment process. The $CO_2$ stream provides cooling for the natural gas N2 and the main refrigerant M2 down to a level of about −30 to −55° C. The refrigeration is provided by the compressed pre-cooling refrigerant P1 which is first condensed in the cooler CW1 by the sea water. The condensed pre-cooling refrigerant stream P3 from the drum D1 is flashed through Joule Thompson valves V1A, V1B and V1C in three pressure levels in cryogenic heat exchangers E1A, E1B and E1C. The vaporised pre-cooling refrigerants P5, P8 and P11 are returned through the suction drums D2, D3 and D4 to the compressor C1 where the pre-cooling refrigerant is recompressed up to 45 to 60 barg because of the three different pressure levels (5.5 to 7 barg, 10 to 20 barg and 25 to 35 barg) at which pre-cooling refrigerants P4, P7 and P10 evaporate the streams are returned to the compressor C1 at three different pressure levels. The compressor C1 is designed to receive the low pressure stream P12 (5.5 to 7 bara) at the suction and other medium pressure streams P9 and P6 (10 to 20 bara and 25 to 35 bara) at interstage positions. This improves the efficiency of the pre-cooling cycle. The required liquid hold-up for the pre-cooling circuit is provided by the drum D1.

The main cooling refrigerant cycle ensures the liquefaction and sub-cooling of the pre-cooled natural gas stream N8 and auto-cooling of the main refrigerant itself. The main cooling refrigerant is taken from the overhead of the hydrocarbon removal tower and enriched with nitrogen having essentially the following composition: 0 to 15 mol % nitrogen, 10 to 90 mol % methane, 0 to 90 mol % ethane, 0 to 30 mol % propane and 0 to 10 mol % butanes.

The main cooling refrigerant MS is partially condensed in the cryogenic heat exchangers E1A, E1B and E1C and is separated to a liquid and vapour phase in the separate D5 at −30 to −55° C. The vapour phase is the light main cooling refrigerant M8, high in nitrogen and methane content while the liquid phase is the heavy main cooling refrigerant M7, high in ethane and propane content. The MB is condensed and sub-cooled in the tube side of the E2 and expanded in the Joule Thompson valve V2 (or in the liquid turbine) to a low pressure 0.2 to 6 barg and routed to the shell side of the E2. The evaporation of the M11 ensures the sub-cooling of natural gas stream N9 and its own sub-cooling.

The heavy main cooling refrigerant M7 from the separator D5 is sub-cooled in the tube side of the cryogenic heat exchanger E2 and expanded through Joule Thompson valve V3 to a low pressure 0.2 to 6 barg and routed to the shell side of E2. This stream is mixed with the light main cooling refrigerant and the evaporation of this stream provides the refrigeration required for liquefaction of the natural gas stream and the light main cooling refrigerant.

The evaporated and slightly superheated main cooling refrigerant M14 is routed to the suction drum D6 of the compressor C2, where it is compressed to 6 to 20 barg, intercooled in the water cooler CW3 and further compressed in the C3 to 20 barg. The compressed main cooling refrigerant M1 is desuperheated in the water cooler CW4 and re-routed to pre-cooling heat exchangers E1A, E1B and E1C.

Further details of the condensation and evaporation mechanism of the refrigerants and LNG will be understood by a person skilled in the art having reference to the disclosure of WO 98/48227.

Figure 3:
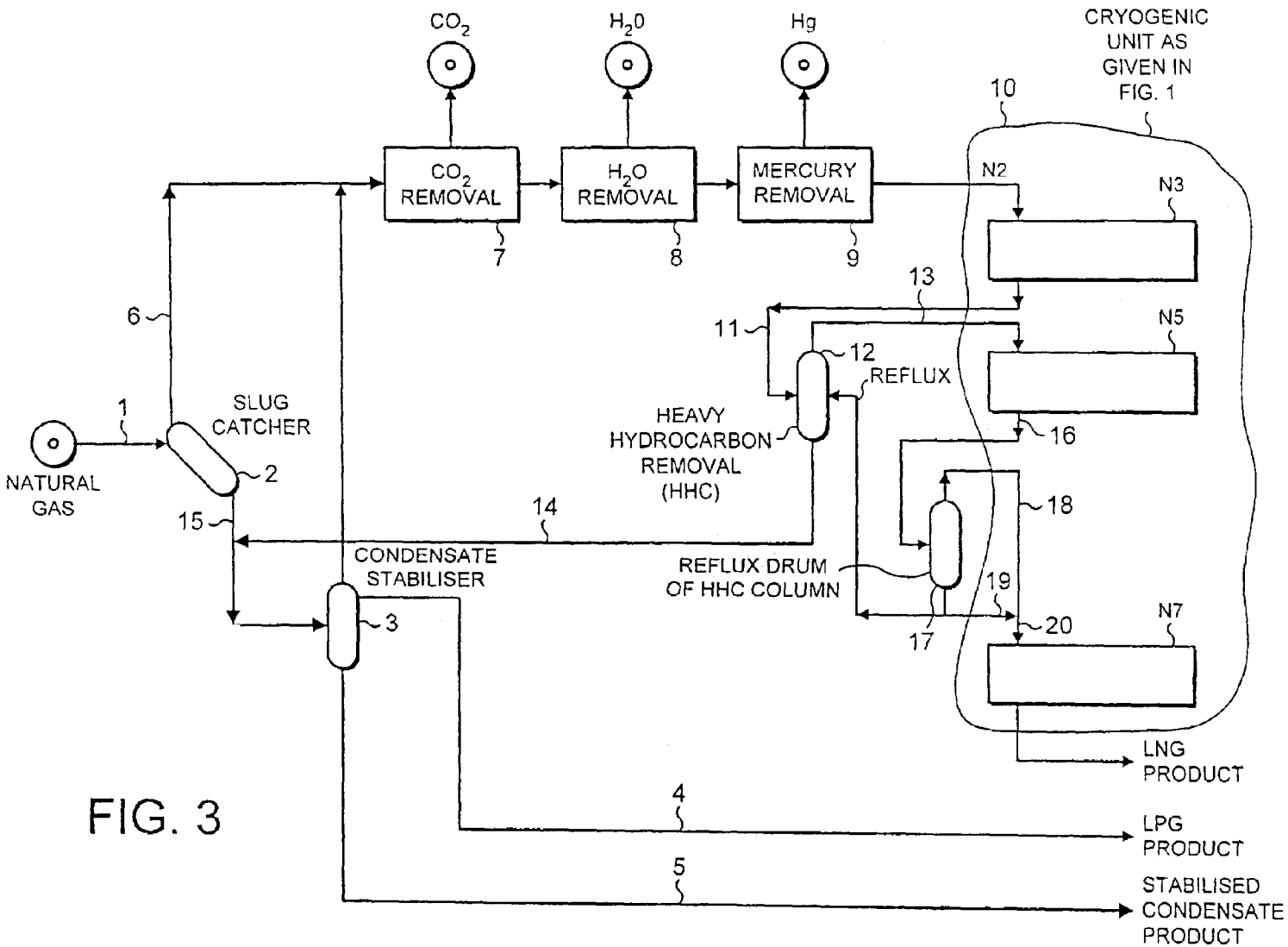
FIG. 3 is a flowsheet of the LNG plant as a whole incorporating the LNG liquefaction system as shown in FIG. 1.

The overall flow scheme of the LNG plant shown in FIG. 3 essentially shows the pre-treatment of the raw natural gas stream before it enters the LNG liquefaction system previously described in FIG. 1 to produce the desired LNG product.

The raw natural gas feed 1 is pre-treated by processing it through a slug catcher 2 to remove heavy residues. Typically, the raw natural gas may comprise 0–5 mol % nitrogen, 0–20 mol % carbon dioxide, 50–100 mol % $C_1$, 0–10 mol % $C_2$, 0–10 mol % $C_3$, 0–10 mol % $C_4$ and 0–5 mol % $C_5$+. The heavy residues are fed to a separator 3 which produces an LPG product stream 4 and a stabilised condensate product stream 5. The natural gas stream 6 leaving the top of the slug catcher 2 is subjected to a series of pre-treatment steps including carbon dioxide removal 7, water removal 8 and mercury removal 9, before entering the system of heat exchangers 10 according to FIG. 1.

After passing through the heat exchanger N3, the natural gas 11 passes through a heavy hydrocarbon removal unit 12 in which the lighter hydrocarbons 13 leave the top of the column 12 and pass through the heat exchanger N5 where condensation takes place. The bottoms 14 from the heavy hydrocarbons removal unit are fed into the heavy residue stream 15 from the slug catcher and subsequently leave the system in the LPG product and stabilised condensate product streams 4 and 5. The natural gas stream 16 after condensing in heat exchanger N5 is passed through the reflux drum 17 of the heavy hydrocarbon removal unit 12. The stream 18 from the top of the reflux drum 17 continues through heat exchanger N7 and is topped up by some of the bottoms 19 from the reflux drum 17. The remainder of the bottoms 19 from the reflux drum 17 are recycled back into the heavy hydrocarbon removal unit 12. The heat exchanger N7 provides further cooling of the liquefied natural gas stream 20. Further cooling steps may take place in further heat exchangers (not shown) as described earlier with reference to FIG. 1.

Since the refrigerant stream in the main cooling circuit of FIG. 1 contains predominantly nitrogen, recycle of hydrocarbons from the natural gas stream is not necessary and is not shown. However, if desired, some light hydrocarbons from 13 the top of the heavy hydrocarbon removal unit 12 or, more preferably, from the top of the reflux drum 17 could be used in a refrigerant make-up stream (not shown).

Figure 4:
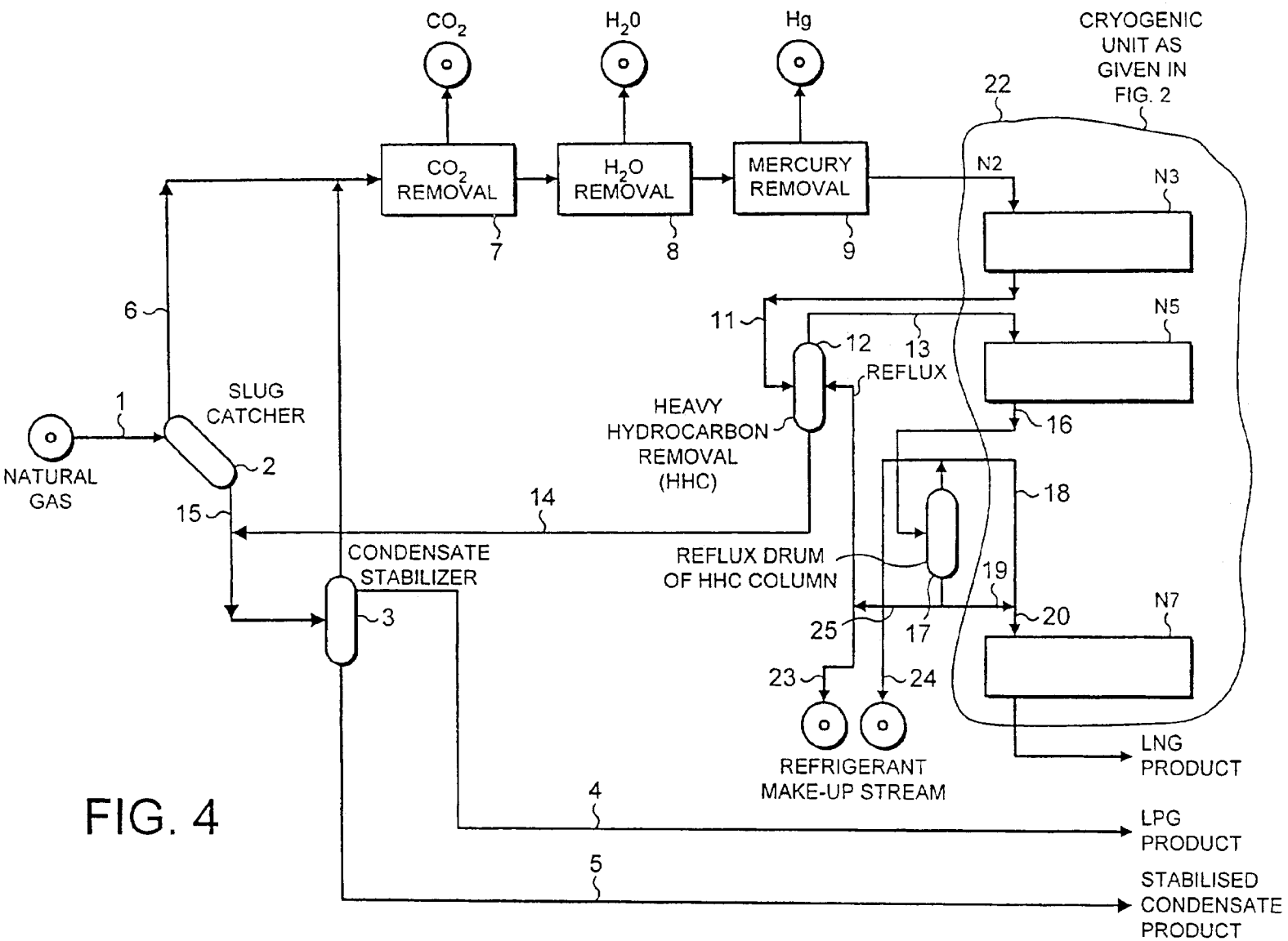
FIG. 4 is a flowsheet of the LNG plant as a whole incorporating the LNG liquefaction system as shown in FIG. 2.

FIG. 4 shows a flow scheme of the overall LNG plant incorporating the liquefaction system 22 using a mixed hydrocarbon and nitrogen refrigerant stream as shown in FIG. 2. Pre-treatment of the raw natural gas stream 6 and the fate of the LPG product and stabilised condensate product streams 4 and 5 are shown in the same way as described above in relation to FIG. 3.

However, the liquefaction system shown in FIG. 4 also contains a refrigerant make-up stream 23, 24 comprising hydrocarbons enriched with nitrogen, in accordance with the system of FIG. 2. Therefore, a refrigerant make-up stream 23 comprising hydrocarbons from the reflux drum 17 is shown. The light hydrocarbons 13 in the stream from the top of the heavy hydrocarbon removal unit 12 passes through heat exchanger N5 and then into the reflux drum 17. From the top of the reflux drum 17, some of the natural gas stream is removed to form the refrigerant make-up 24. Some of the heavy hydrocarbons 25 from the bottom of the reflux drum 17 are also used in the refrigerant make-up stream 23, and the remainder is refluxed back into the heavy hydrocarbon removal unit 12.

Although heat exchangers N3, N5 and N7 only are shown in this drawing, further heat exchangers as described in FIG. 2 may be necessary or desired to produce the LNG product stream.

Figure 5:
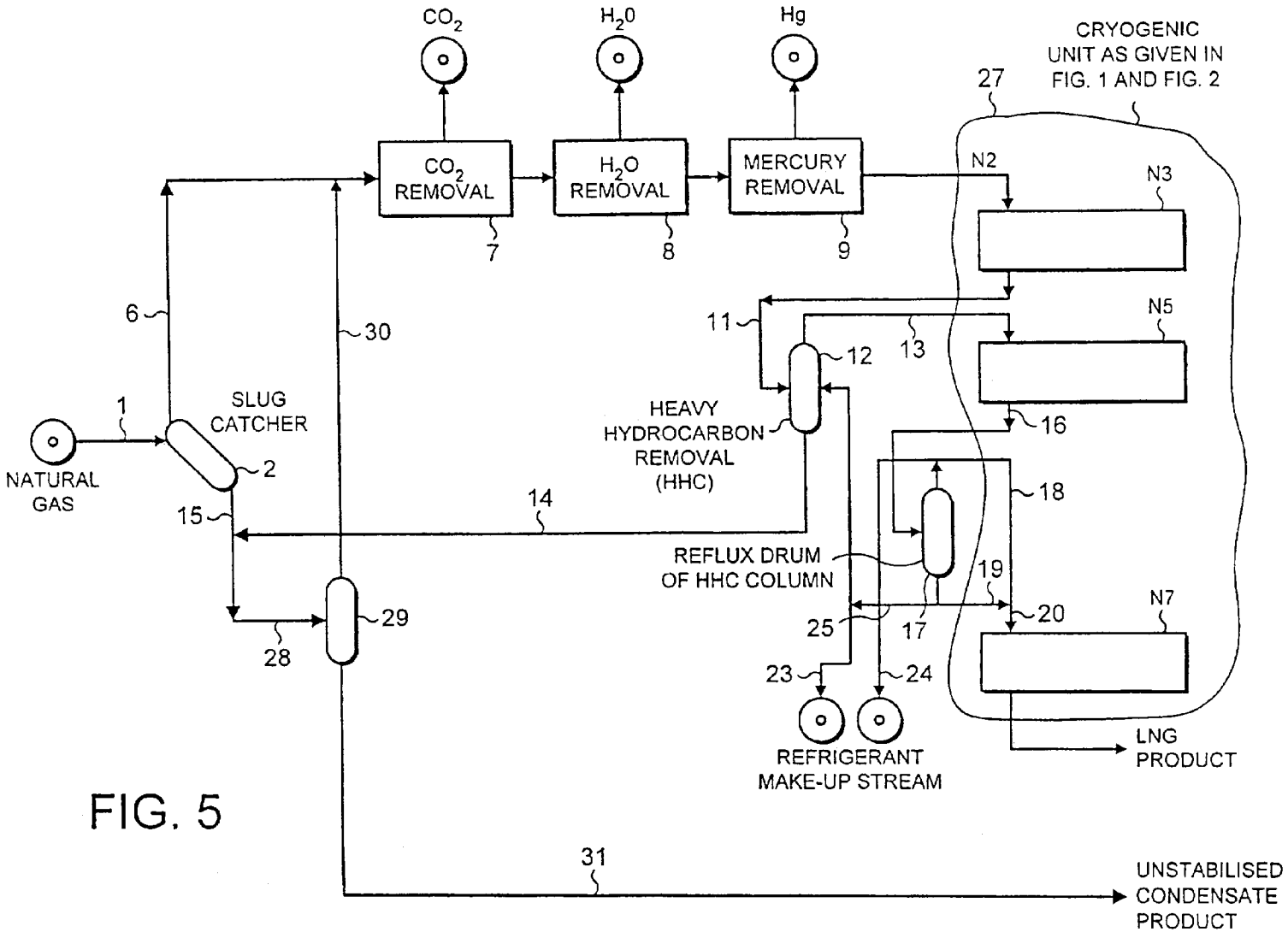
FIG. 5 is a flowsheet of the LNG plant as a whole producing only two product streams: LNG and unstabilised condensate product.

FIG. 5 shows an overall flow scheme of the LNG plant in which the raw natural gas stream is pre-treated as described in FIG. 3. The natural gas liquefaction system 27 in accordance with FIG. 2 is shown, and includes the refrigerant make-up streams 23,24 taken from the hydrocarbon streams from the reflux drum 17. However, the liquefaction system 27 shown in FIG. 1 and described above could be used instead.

The bottoms 14 from the heavy hydrocarbon removal column are fed into the stream 15 exiting the bottom of the slug catcher, and the combined stream 28 is fed into a condensate removal column 29. The tops 30 from the condensate removal column 29 are recycled back into the natural gas stream 6 prior to pre-treatment by carbon dioxide, water and mercury removal, 7, 8 and 9, as shown. It will be noted that a single product stream is removed from the bottom of the separator in the form of an unstabilised condensate product stream 31. This product stream need not undergo any further separation before it is transported. On the contrary, by this means only two separate streams need be transported, compared to three in the conventional arrangement.

The invention claimed is:

1. A natural gas liquefaction process in which the gas is liquefied at a temperature not greater than about −150° C. wherein the gas is cooled by a carbon dioxide based pre-cooling circuit in a cascade arrangement with at least one main cooling circuit, wherein the carbon dioxide pre-cooling circuit cools both the natural gas and a refrigerant of a main cooling circuit.

2. A process according to claim 1, wherein the at least one main cooling circuit is comprised of a plurality of refrigeration compressors and a plurality of cryogenic heat exchangers.

3. A process according to claim 1, wherein the at least one main cooling circuit uses a nitrogen rich refrigerant.

4. A natural gas liquefaction process in which the gas is liquefied at a temperature not greater than about −150° C., wherein the gas is cooled by a carbon dioxide based pre-cooling circuit in a cascade arrangement with at least one main cooling circuit, and wherein the at least one main cooling circuit comprises a circuit using a nitrogen enriched natural gas where the make-up is taken partly from the overhead of a hydrocarbon removal unit and partly from a reflux drum of a heavy hydrocarbon removal unit.

5. A process according to claim 2, wherein the suction of the refrigeration compressors receives unheated, cold refrigerant medium directly from the cryogenic heat exchangers.

6. The process according to claim 4, wherein the bottoms from the hydrocarbon removal unit are sent to a unit for stabilising condensate.

7. A natural gas liquefaction apparatus in which the gas is liquefied at a temperature not greater than about −150° C., and wherein a carbon dioxide based pre-cooling circuit is provided in a cascade arrangement with at least one main cooling circuit, wherein the carbon dioxide pre-cooling circuit cools both the natural gas and a refrigerant of the main cooling circuit.

8. An apparatus according to claim 7, wherein the at least one main cooling circuit comprises a nitrogen rich based expansion loop.

9. An apparatus according to claim 7, wherein the at least one main cooling circuit uses as a refrigerant a gas stream, at least a portion of which is derived from the raw natural gas source.

10. The natural gas liquefaction apparatus of claim 9 wherein at least one main cooling circuit uses as a refrigerant a nitrogen-enriched natural gas stream, at least a portion of which is derived from the raw natural gas source.

11. A natural gas liquefaction process in which the gas is liquefied at a temperature not greater than about −150° C., wherein the gas is cooled by a carbon dioxide based pre-cooling circuit in a cascade arrangement with at least one main cooling circuit, and wherein an unstabilized condensate product stream is produced consisting essentially of a combined condensate and liquefied petroleum gas (LPG) stream.

12. A method of transporting a natural gas product, comprising the steps of producing a liquefied natural gas (LNG) stream and an unstabilized condensate product stream, and transporting said LNG stream and said unstabilized condensate product stream, wherein the unstabilized condensate product stream consists essentially of a combined condensate and liquefied petroleum gas (LPG) stream, and wherein the natural gas product is produced by a natural gas liquefaction process in which the gas is liquefied at a temperature not greater than about −150° C., wherein the gas is cooled by a carbon dioxide based pre-cooling circuit in a cascade arrangement with at least one main cooling circuit.

13. A natural gas liquefaction apparatus in which the gas is liquefied at a temperature not greater than about −150° C., wherein a carbon dioxide based pre-cooling circuit is provided in a cascade arrangement with at least one main cooling circuit, wherein the at least one main cooling circuit uses as a refrigerant a gas stream, at least a portion of which is derived from the raw natural gas source, and wherein said gas stream has a portion made-up from a light hydrocarbon stream from a reflux drum of a heavy hydrocarbon removal unit.

14. The apparatus according to claim 13, wherein a circuit of the at least one main cooling circuit uses a nitrogen enriched natural gas stream where the make-up of that gas is taken partly from the overhead of a hydrocarbon removal unit and partly from the reflux drum of the heavy hydrocarbon removal unit.

15. An apparatus according to claim 7, wherein the at least one main cooling circuit is comprised of a plurality of refrigeration compressors and a plurality of cryogenic heat exchangers, and wherein the suction of the refrigeration compressors receives unheated, cold refrigerant medium directly from the cryogenic heat exchangers.

16. The apparatus according to claim 13, wherein the bottoms from the hydrocarbon removal unit are sent to a condensate stabilizer column.

17. An apparatus according to claim 7 wherein a refrigerant stream used in the at least one main cooling circuit comprises approximately 50 to 100 mol % nitrogen and about 0 to 50 mol % hydrocarbons.

18. An apparatus according to claim 7 wherein a refrigerant stream used in the at least one main cooling circuit comprises about 0 to 15 mol % nitrogen and 50 to 100 mol % hydrocarbons.

* * * * *